US006408503B1

(12) United States Patent
Schwarzkopf

(10) Patent No.: US 6,408,503 B1
(45) Date of Patent: Jun. 25, 2002

(54) METHOD OF MAKING INJECTION-MOLDER HEATING ELEMENT

(75) Inventor: Eugen Schwarzkopf, Lüdenscheid (DE)

(73) Assignee: Hotset Heizpatronen U. Zubehor GmbH, Ludenscheid (DE)

( * ) Notice: Subject to any disclaimer, the term of this patent is extended or adjusted under 35 U.S.C. 154(b) by 0 days.

(21) Appl. No.: 09/422,704

(22) Filed: Oct. 21, 1999

(30) Foreign Application Priority Data

Mar. 18, 1999 (DE) ..... 199 12 084

(51) Int. Cl.[7] ..... H05B 3/00
(52) U.S. Cl. ..... 29/611; 219/536; 219/549
(58) Field of Search ..... 29/610, 611, 612, 29/613, 614, 619; 219/149, 153, 523, 536, 544, 549, 534

(56) References Cited

U.S. PATENT DOCUMENTS

| | | | | | |
|---|---|---|---|---|---|
| 2,375,058 | A | * | 5/1945 | Wiegand | 29/611 |
| 3,068,563 | A | * | 12/1962 | Reverman | 29/458 |
| 3,311,969 | A | * | 4/1967 | Dillon | 29/611 |
| 3,315,334 | A | * | 4/1967 | Sterling | 29/611 |
| 3,330,034 | A | * | 7/1967 | Price | 29/611 |
| 3,499,217 | A | * | 3/1970 | Mochizuki | 29/612 |
| 4,044,225 | A | * | 8/1977 | Pease | 29/611 |
| 4,045,653 | A | * | 8/1977 | Sopper | 219/438 |
| 4,112,410 | A | * | 9/1978 | Wrob | 29/611 |
| 5,276,966 | A | * | 1/1994 | Grant | 29/890.042 |
| 5,868,536 | A | * | 2/1999 | Nojikawa | 411/310 |

FOREIGN PATENT DOCUMENTS

| | | | |
|---|---|---|---|
| DE | 42 42 505 | | 6/1994 |
| DE | 195 41 504 | | 5/1997 |
| GB | 182782 | * | 6/1992 |

* cited by examiner

*Primary Examiner*—Carl J. Arbes
*Assistant Examiner*—Sean Smith
(74) *Attorney, Agent, or Firm*—Herbert Dubno; Andrew Wilford

(57) ABSTRACT

A method of making a heater element has the steps of inserting into a smooth tubular casing a heating wire, filling a space between the wire and the casing with a compressible insulating mass, and closing ends of the space to confine the mass in the casing. Then the casing is radially inwardly compressed to form therein a successive of radially outwardly open annular grooves extending circumferentially fully around the casing and thereby radially compressing the insulating mass. The casing is formed with a succession of such grooves, which can be of V-shape and which are each endless so that the casing is corrugated. Alternately the grooves are interconnected helically. Either way in accordance with the invention the grooves form axially relatively long and radially relatively thick outer rings and axially relatively short and radially relatively thin inner rings.

4 Claims, 4 Drawing Sheets

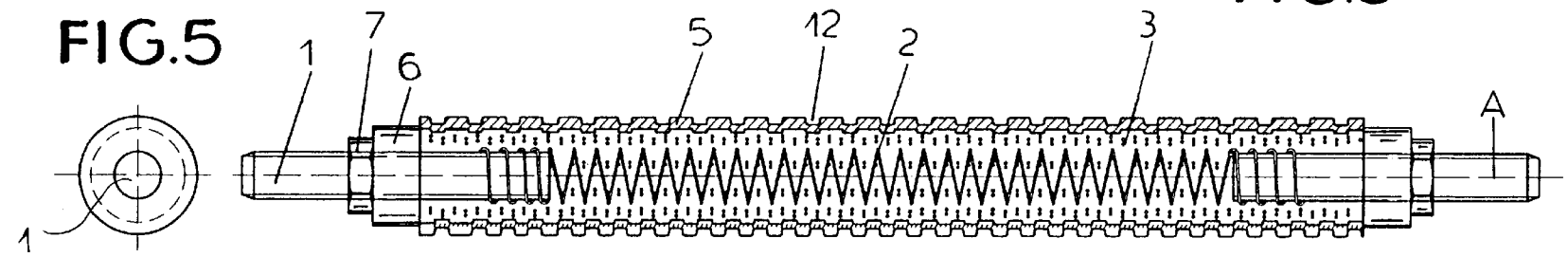
FIG.3
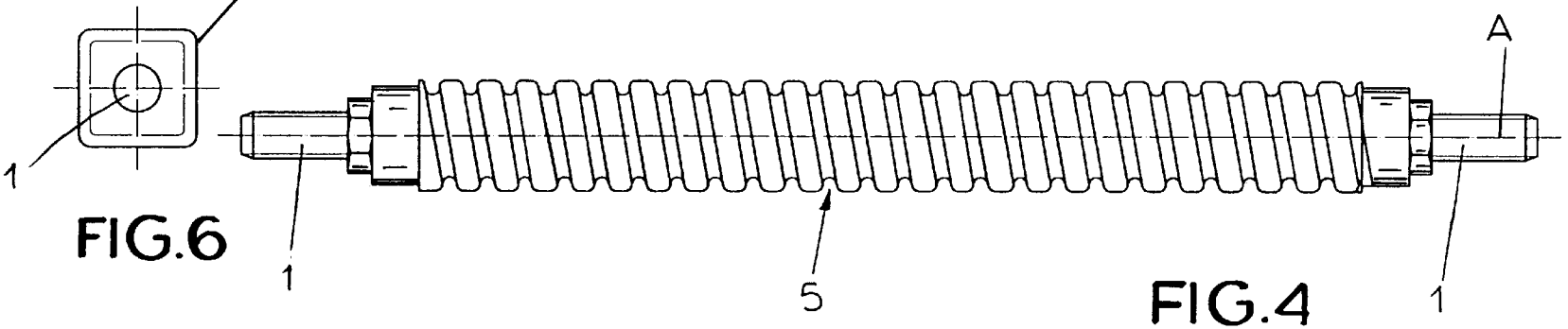
FIG.4
FIG.5
FIG.6

METHOD OF MAKING INJECTION-MOLDER HEATING ELEMENT

FIELD OF THE INVENTION

The present invention relates to a method of making a heater element. More particularly this invention concerns the manufacture of such an electrical heating element used in an injection-molding machine.

BACKGROUND OF THE INVENTION

An electrical heating element for an injection-molding machine or the like has a normally helical resistive wire that is surrounded by an insulating mass and held in a metallic tubular casing. The ends of the tubular casing are fitted with dielectric caps carrying terminals connected to the ends of the resistive wire so electricity can be passed through the wire to heat it. This heat is transmitted through the insulating mass, which is a dielectric and not thermal insulation, to the tubular casing and thence to the part the heater is fitted to. Such devices are mass produced and are subject to considerable wear and tear so they must be replaced periodically. In addition these heaters often need to be shaped to fit around a particular part or in a groove of a part.

Such a heater is typically made by assembling all but the cap and terminal at one end of the heater. The insulation mass is poured into the open end of the tube to fill it, and the other cap and terminal are installed to complete the assembly. If the mass is too loose there is poor heat conduction and the wire can directly contact the surrounding metal casing. It has been suggested therefore to somewhat flatten the heater to compact this mass, but such flattening results in a shape that is difficult to shape and diametral flattening produces nonuniform compaction of the mass in the casing in any case.

If the casing is smooth it is likely to kink when bent, so German 42 42 505 suggests making the tubular casing corrugated. This, however, makes it very difficult to fill densely and makes it impossible to radially compact the casing later. In another system described in German patent document 195 41 504 the insulating mass is a dielectric but heat-conducting metal powder and the casing is smooth. The smooth inner casing in turn is surrounded by a corrugated outer sleeve and the space between them is filled with another insulating mass. Such a system is fairly effective as it allows at least the inner mass to be compacted, but manufacture is fairly expensive.

OBJECTS OF THE INVENTION

It is therefore an object of the present invention to provide an improved method of making an electrical heating element.

Another object is the provision of such an improved method of making an electrical heating element which overcomes the above-given disadvantages, that is which is fairly simple and inexpensive to carry out but which produces an electrical heating element that can be readily bent and that has a densely compacted insulating mass between the resistive wire and the surrounding casing.

SUMMARY OF THE INVENTION

A method of making a heater element has according to the invention the steps of inserting into a smooth tubular casing a heating wire, filling a space between the wire and the casing with a compressible insulating mass, and closing ends of the space to confine the mass in the casing. Then according to the invention the casing is radially inwardly compressed to radially compress the insulating mass and also to form in the casing a successive of radially outwardly open annular grooves extending circumferentially fully around the casing.

By radially compressing the casing to form the bendfacilitating grooves in it after filling it with the insulating mass, excellent and perfectly uniform compression of this mass is insured. Thus in a single simple manufacturing procedure, typically done by passing the assembled heater between a pair of appropriately shaped rollers, it is possible both to compact the mass in it and form it with the grooves necessary to make it easy to bend. The resultant heater can be made at the same cost as a prior-art heater but will be of substantially higher quality.

According to the invention the casing is formed with a succession of such grooves, which can be of V-shape and which are each endless so that the casing is corrugated. Alternately the grooves are interconnected helically. Either way in accordance with the invention the grooves form axially relatively long and radially relatively thick outer rings and axially relatively short and radially relatively thin inner rings. The inner rings deform readily so that the heater can be given virtually any desired shape.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIGS. 3 and 4 are views like respective FIGS. 1 and 2 of another heater in accordance with the invention;

FIG. 5 is an end view of the heater of FIG. 3;

FIG. 6 is an end view of another heater according to the invention;

SPECIFIC DESCRIPTION

Figure 1:
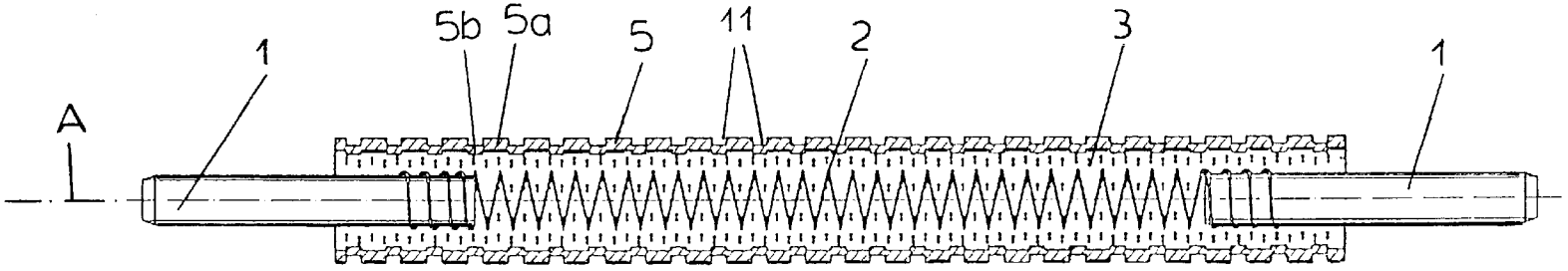
FIG. 1 is an axial section through a heater according to the invention.
Figure 2:
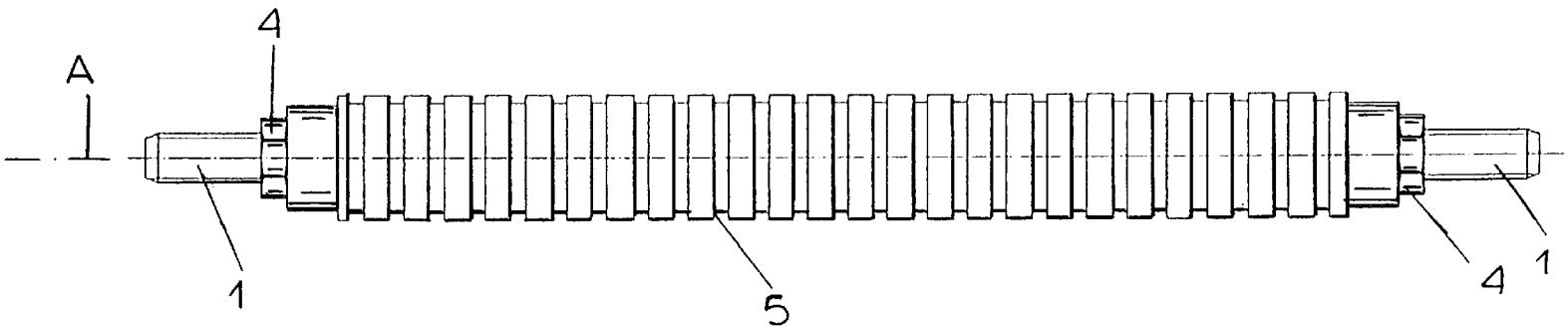
FIG. 2 is a side view of the heater of FIG. 1.

As seen in FIGS. 1 and 2, a heater according to the invention has a pair of end terminals 1 spaced apart along and centered on a common axis A and connected to ends of a helical resistive element or wire 2. A mass 3 of magnesium-oxide powder surrounds the element 2 and is confined by end caps or plugs 4 in an outer tubular casing 5. The casing 5 is formed of nickel or, preferably, stainless steel with a multiplicity of annularly continuous grooves 11. To this end it is constituted as a series of axially relatively long and radially relatively thick outer rings 5*a* and relatively short and radially thin inner rings 5*b*.

FIGS. 3, 4, and 5 show another such system but where a single helical V-shaped groove 12 is formed, so in effect the inner and outer rings are all connected together helically.

Here ceramic end caps 6 carry nuts 7 and the terminals 1, as in FIGS. 1 and 2, are threaded.

FIG. 6 shows how the heater can be of square section instead of the circular section of FIGS. 1 to 5.

Figure 7:
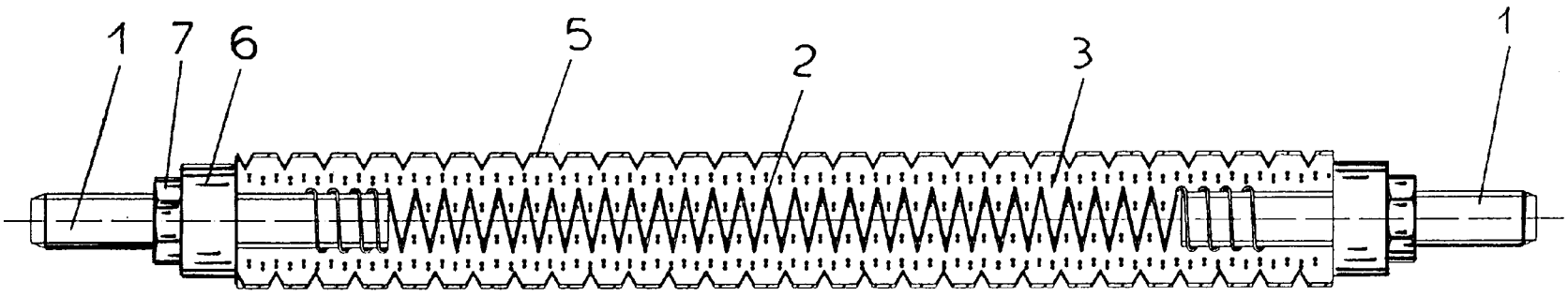
FIG. 7 is a section through a further heater in accordance with the invention.
Figure 8:
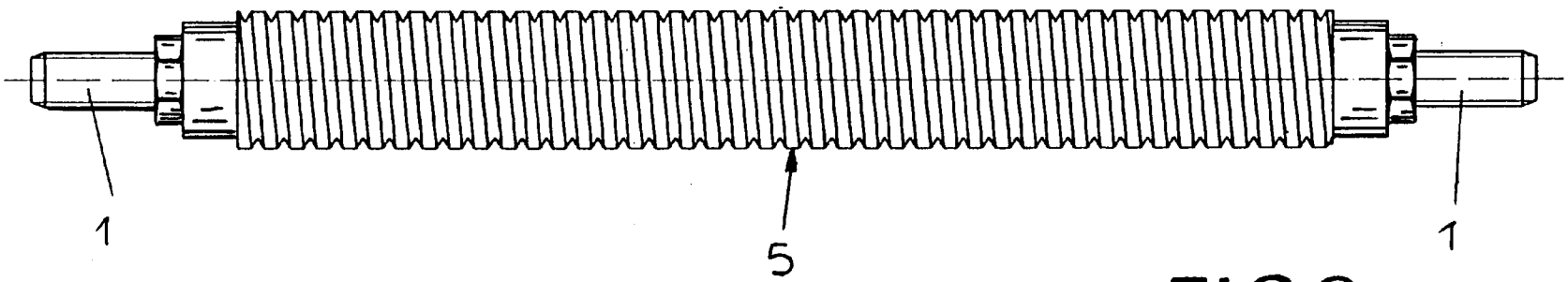
FIG. 8 is a side view of another heater.

In FIGS. 7 and 8 a helical V-shaped groove is formed in the casing 5.

Figures 9A, 9B, 9C, 9D:
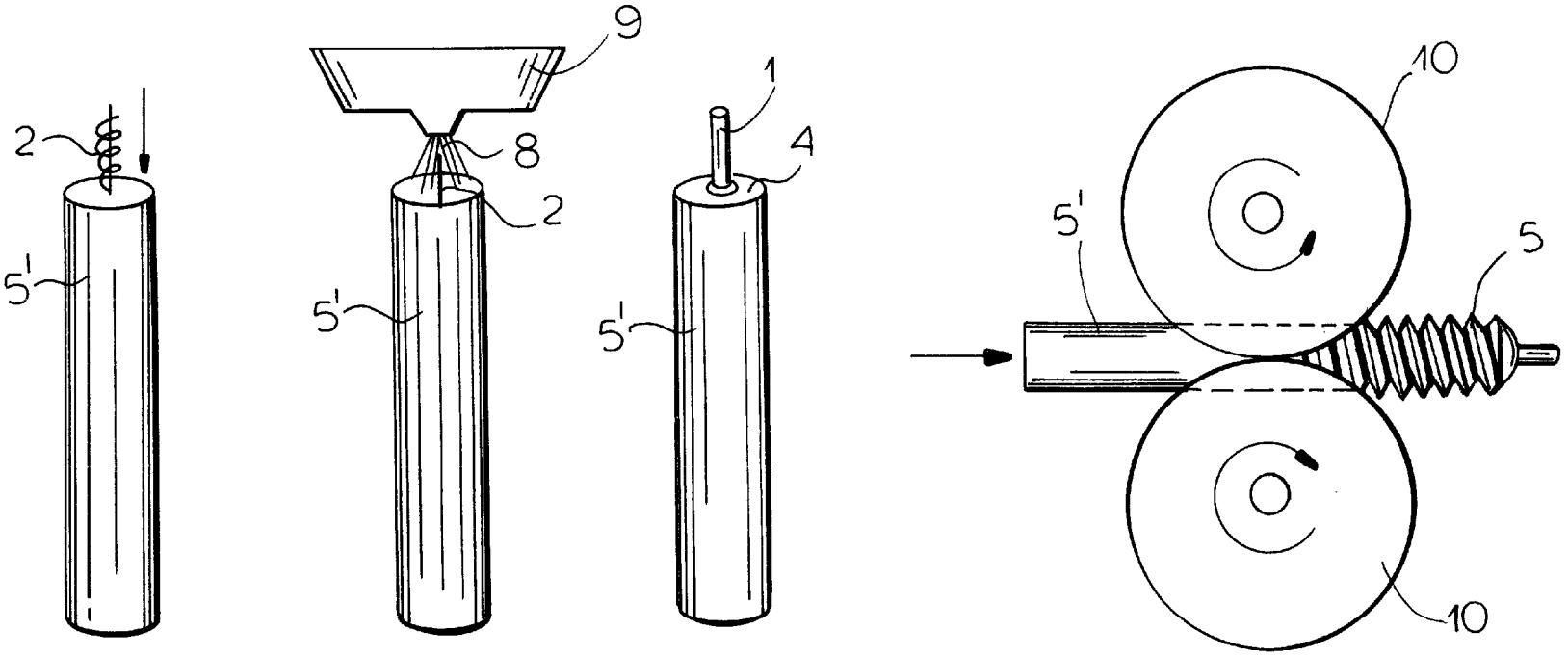
FIGS. 9A to 9D are schematic illustrations of steps of the method of this invention.

FIGS. 9A to 9D show the four basic steps necessary to manufacture such a heater. First of all as shown in FIG. 9A the heater 2 is inserted in a smooth cylindrical casing 5' and the assembly is completed except for the mass 3 and one end cap 4 and terminal 1. Then (FIG. 9B) the mass is introduced into the casing 5' around the wire 2 as a powder 8 from a supply 9. The other end cap 4 is then installed as shown in FIG. 9C. Finally (FIG. 9D) according to the invention the cylindrical casing 5' is passed between two rollers 10 that form the grooves 11 or 12 in it. To this end each roller has a U-shaped and radially out-wardly open groove of semi-circular shape formed with internal transverse ridges that push in selected portions of the wall of the cylindrical tube 5' to form the desired groove 11 or 12 and reduce the overall diameter of the casing 5' by up to 15%.

I claim:

1. A method of making a heater element comprising the steps of:

inserting into a tubular casing a heating wire;

filling a space between the wire and the casing with a compressible insulating mass;

closing ends of the space to confine the mass in the casing; and radially inwardly compressing and plastically deforming the casing to form in it a succession of radially outwardly open annular grooves that extend circumferentially fully around the casing and that form axially relatively long and radially relatively thick outer rings and axially relatively short and radially relatively thin inner rings and thereby radially compressing the insulating mass.

2. The method defined in claim 1 wherein the casing is formed with a succession of such grooves that are each endless.

3. The method defined in claim 1 wherein the casing is compressed by rolling.

4. The method defined in claim 1 wherein a diameter of the casing is reduced by up to 15% when it is inwardly compressed.

* * * * *